US010654501B2

(12) United States Patent
Rude

(10) Patent No.: US 10,654,501 B2
(45) **Date of Patent: *May 19, 2020**

(54) RAILROAD CAR TRACKING SYSTEM

(71) Applicant: Eighty Eight Oil, LLC, Casper, WY (US)

(72) Inventor: Austin R. Rude, Casper, WY (US)

(73) Assignee: Eighty-Eight Oil LLC, Casper, WY (US)

( * ) Notice: Subject to any disclaimer, the term of this patent is extended or adjusted under 35 U.S.C. 154(b) by 53 days.

This patent is subject to a terminal disclaimer.

(21) Appl. No.: 16/003,699

(22) Filed: Jun. 8, 2018

(65) Prior Publication Data

US 2018/0290675 A1 Oct. 11, 2018

Related U.S. Application Data

(63) Continuation of application No. 14/922,639, filed on Oct. 26, 2015, now Pat. No. 10,266,188.

(60) Provisional application No. 62/094,298, filed on Dec. 19, 2014.

(51) Int. Cl.
*B61L 25/02* (2006.01)
*B61L 27/00* (2006.01)

(52) U.S. Cl.
CPC ..... *B61L 25/028* (2013.01); *B61L 25/025* (2013.01); *B61L 27/0077* (2013.01); *B61L 2205/04* (2013.01)

(58) Field of Classification Search
CPC .. B61L 25/028; B61L 25/025; B61L 27/0077; B61L 2205/04
USPC ..... 701/117
See application file for complete search history.

(56) References Cited

U.S. PATENT DOCUMENTS

| | | | |
|---|---|---|---|
| 6,456,937 | B1 | 9/2002 | Donor |
| 8,604,943 | B2 | 12/2013 | Adelson |
| 9,070,295 | B2 | 6/2015 | Adelson |
| 9,082,097 | B1 | 7/2015 | Adelson |
| 9,082,098 | B1 | 7/2015 | Adelson |
| 9,087,313 | B1 | 7/2015 | Adelson |

(Continued)

OTHER PUBLICATIONS

Railcar Tracking—RSInet Rail Transportation Management Software'; http://rsi.rsilogics.com/railcar-tracking; Apr. 16, 2014.

(Continued)

*Primary Examiner* — Gertrude Arthur Jeanglaude
(74) *Attorney, Agent, or Firm* — Allan Watts

(57) ABSTRACT

Tracking railroad cars during transit using computer implemented methods. Location information for railroad cars is obtained from sensors through a computer network and input into a computer system. Locations of trains are represented by train symbols on a graphical representation of a geographical region. In different embodiments, the location information is used to determine how the railroad cars are grouped into trains; when an operator selects one of the train symbols, one railcar symbol is displayed for each of the railroad cars that make up the train; or a bad ordered car is depicted. In various embodiments, GPS coordinates are used, shapes of locomotives or railcars are used, train symbols are shown at a shifted location when two of the trains are close together, a particular train is displayed in an ocean when location information is unavailable, or railcar symbols are displayed in a spiral pattern.

20 Claims, 6 Drawing Sheets

(56) References Cited

U.S. PATENT DOCUMENTS

| | | | | |
|---|---|---|---|---|
| 10,266,188 | B2 * | 4/2019 | Rude | B61L 25/025 |
| 2002/0049622 | A1 | 4/2002 | Lettich et al. | |
| 2003/0236598 | A1 | 12/2003 | Villarreal Antelo | |
| 2005/0021522 | A1 | 1/2005 | Herman | |
| 2005/0205719 | A1 | 9/2005 | Hendrickson et al. | |
| 2007/0146159 | A1 | 6/2007 | Kato et al. | |
| 2008/0055043 | A1 | 3/2008 | Webb et al. | |
| 2010/0032529 | A1 | 2/2010 | Kiss et al. | |
| 2013/0265155 | A1 | 10/2013 | Wible et al. | |
| 2014/0089032 | A1 | 3/2014 | Bell | |

OTHER PUBLICATIONS

Track and Trace—CSX'; http://www.csx.com/index.cfm/customers/tools/shipcsx/track-and-trace/; Apr. 16, 2014.

Enspire: Railcar Management Solutions'; Greenbrier Management Services; www.gbrx.com; pp. 1-4 Jan. 1, 2015.

Railcar Tracking Co.—RMS v.6 is Now Available'; http://www.railcartracking.com/product.htm; Apr. 16, 2014.

Rail Track and Trace'; http://www.rmiondemand.com/solutions/shippers/rail_shipment_manageme . . . '; Apr. 16, 2014.

Railroad Mechanical Article: Railroads & car tracking technology'; Progressive Railroading; http://www.progressiverailroading.com/mechanical/article/Railroads-38-cartracking-technology-25010'; pp. 1-3; Apr. 16, 2014.

Railinc Corporation—Wikipedia'; http://en.wikipedia.org/wiki/Railinc_Corporation; pp. 1-6; Aug. 19, 2014.

* cited by examiner

RAILROAD CAR TRACKING SYSTEM

RELATED PATENT APPLICATIONS

This patent application is a continuation of, and claims priority to, U.S. non-provisional patent application Ser. No. 14/922,639, filed Oct. 26, 2015, having the same title, inventor, and assignee, which is a non-provisional patent application of, and claims priority to, U.S. provisional patent application No. 62/094,298, filed Dec. 19, 2014, having the same title, inventor, and assignee. The contents of both of these priority patent applications are incorporated herein by reference. If there are any conflicts or inconsistencies between this patent application and a patent application incorporated by reference, however, this, patent application governs herein.

FIELD OF THE INVENTION

Various embodiments of this invention relate to methods and apparatuses for tracking railroad cars during transit. Particular embodiments relate to computer implemented methods and apparatuses that include at least one computer system that contains machine-readable instructions that, when executed by the computer system, performs certain acts. Various embodiments are used for managing shipment of petroleum products, for example, such as oil.

BACKGROUND OF THE INVENTION

Organizations that ship commodities or products by rail, such as oil companies that ship oil by rail, would benefit from an improved way to track their train cars, for example, across the United States, so they can plan better, and know, for instance, when a car has been bad ordered. Certain railroads give their customers a particular degree of insight as to where trains and cars are when they are using their tracks, but once they leave that particular railroad's tracks it can be hard for an organization to track their cars.

When a car is bad ordered, often times the organization that owns or leases the car is not notified of the order. When schedulers for the organization are trying to find the car, they have had to sort through thousands of messages of textual data, for example, to find the car's last location and identify the issue with the car. Organizations that ship by rail would benefit from a graphical way to track their trains and cars across the United States, for example. Room for improvement exists over the prior art in these and other areas that may be apparent to a person of ordinary skill in the art having studied this document.

SUMMARY OF PARTICULAR EMBODIMENTS OF THE INVENTION

This invention provides, among other things, computer systems, apparatuses, and computer implemented methods for tracking and managing railroad cars during transit. Certain aspects of the embodiments address limitations and flaws in the prior art by providing methods and apparatuses that can be used by organizations that ship goods or commodities by rail. Various embodiments provide, for example, as an object or benefit, that they partially or fully address or satisfy one or more of the needs, potential areas for benefit, or opportunities for improvement described herein, or known in the art, as examples. Different embodiments provide various computer implemented methods of tracking railroad cars during transit. In various embodiments, the method includes machine readable instructions that, when executed, perform certain acts. Such acts can include, for example, various acts described herein.

Specific embodiments include various computer-implemented methods, for example, of tracking railroad cars during transit. In a number of embodiments, the method includes, for instance, in any order, at least certain acts. Such acts can include, for example, inputting into a computer system, for instance through at least one computer network, location information for the railroad cars. Further, in various embodiments, the location information is obtained from multiple scanners, for example, that are positioned along railroad tracks. In a number of embodiments, for example, the scanners scan the railroad cars as the railroad cars pass by the multiple scanners. Still further, various embodiments include, for instance, using the computer system, using the location information for the railroad cars to determine how the railroad cars are grouped into multiple trains. Even further, various methods include, for example, using the computer system, using the location information for the railroad cars, or both, displaying locations of the multiple trains on a graphical representation of a geographical region. Further still, in various embodiments, each of the multiple trains includes at least one of the railroad cars, each of the multiple trains is represented on the geographical region by one of multiple train symbols, or both.

In some such embodiments, the computer-implemented method includes inputting (e.g., into the computer system) GPS coordinates of the multiple scanners. Further, certain embodiments include using the GPS coordinates (e.g., of the multiple scanners) for the displaying of the locations of the multiple trains, for instance, on the graphical representation of the geographical region. Still further, in some embodiments, the act of displaying the locations of the multiple trains includes displaying on a graphical representation of at least one country, displaying multiple rail lines (e.g., overlaid on the graphical representation of the geographical region), or both. Further still, in particular embodiments, the act of displaying the locations of the multiple trains includes displaying a shape of a locomotive, for example, for each of the multiple train symbols. Even further, in certain embodiments, the act of displaying the locations of the multiple trains includes displaying a location of a particular train in an ocean, for instance, when location information is unavailable for that particular train.

Further specific embodiments (e.g., of computer-implemented methods of tracking railroad cars during transit) include, (e.g., in any order), at least acts that include inputting into a computer system location information for the railroad cars, wherein the location information is obtained from multiple sensors, for example, through at least one computer network. In various embodiments, such acts further include, for instance, using the computer system, using the location information for the railroad cars, or both, displaying locations of multiple trains on a graphical representation of a geographical region. In a number of embodiments, each of the multiple trains includes at least one of the railroad cars, each of the multiple trains is represented on the geographical region by one of multiple train symbols, or both, as examples. Still further, in various such embodiments, when an operator of the computer system selects a particular one of the multiple train symbols, for example, the method includes displaying multiple railcar symbols, for instance, for a particular one of the multiple trains that is represented by the particular one of the multiple train symbols. Even further, in a number of embodiments, one railcar symbol (e.g., of the multiple railcar symbols) is displayed for each of multiple of the railroad cars (e.g., that make up the particular one of the multiple trains).

Further, in some such embodiments, each of the multiple railcar symbols is an image of a railcar, for instance, an image of a tank car, or the act of displaying the multiple railcar symbols for the particular one of the multiple trains (e.g., that is represented by the particular one of the multiple train symbols) includes displaying a shape of a railcar (e.g., for each of the multiple of the railroad cars that make up the particular one of the multiple trains). Still further, in particular embodiments, the act of displaying the multiple railcar symbols for the particular one of the multiple trains (e.g., that is represented by the particular one of the multiple train symbols) includes displaying the multiple railcar symbols in a spiral pattern. Even further, some embodiments include an act of displaying additional information for a particular railroad car (e.g., of the railroad cars), for example, when one of the multiple railcar symbols representing the particular railroad car is selected by the operator of the computer system. Further still, in certain embodiments, when two of the multiple trains are close together, at least one of the multiple train symbols (e.g., that represent the two of the multiple trains) is shown (e.g., on the graphical representation of the geographical region) at a shifted location, for example, with a line connecting the at least one of the multiple train symbols to an actual position of a train (e.g., of the two of the multiple trains).

Even further specific embodiments include various computer-implemented methods of tracking railroad cars (e.g., during transit) that include the act of depicting (e.g., on the geographical region) a bad ordered car (e.g., one of the railroad cars). Such embodiments may further include inputting into a computer system location information for the railroad cars, for example, where the location information is obtained from multiple sensors, for instance, through at least one computer network. Further, such embodiments may include (e.g., using the computer system, using the location information for the railroad cars, or both) displaying locations of multiple trains (e.g., on a graphical representation of a geographical region), for example, each of the multiple trains including at least one of the railroad cars, for instance, wherein each of the multiple trains is represented on the geographical region by one of multiple train symbols.

Further, in some such embodiments, the bad ordered car is depicted at a last position of the location information received for the bad ordered car. Still further, some embodiments include displaying history information for the bad ordered car, for example, when a specific train symbol (e.g., of the multiple train symbols) is selected by an operator of the computer system, for instance, for a particular train that the bad ordered car was on before being dropped off the particular train (e.g., one of the multiple trains). Further still, in some embodiments, the act of displaying the locations of the multiple trains includes, for example, when the bad ordered car has been separated from one of the multiple trains, displaying a train symbol for the one of the multiple trains and displaying a railcar symbol for the bad ordered car. Even further, in particular embodiments, the train symbol and the railcar symbol each have a common reference character. Even further still, some embodiments include, for example, when an operator of the computer system selects a particular one of the multiple train symbols, displaying one railcar symbol for each of multiple of the railroad cars (e.g., that make up one of the multiple trains represented by the particular one of the multiple train symbols). Moreover, in certain embodiments, multiple of the railcar symbols are displayed (e.g., for the particular one of the multiple trains), and a first color of the one railcar symbol indicates an empty railroad car with a normal status, a second color of the one railcar symbol indicates a full railroad car with a normal status, a third color of the one railcar symbol indicates a bad ordered railroad car, or a combination thereof. Still further, in particular embodiments, a fourth color (e.g., of the one railcar symbol) indicates a railroad car that has not moved in a particular period of time, a fifth color (e.g., of the one railcar symbol) indicates a railroad car that has been released from being bad ordered, or both. Further still, some embodiments include filtering, for example, to show only bad ordered and held cars, providing at least one report of the bad ordered and held cars, or both.

In addition, various other embodiments of the invention are also described herein, and various benefits of certain embodiments may be apparent to a person of ordinary skill in the art.

Figure 1:
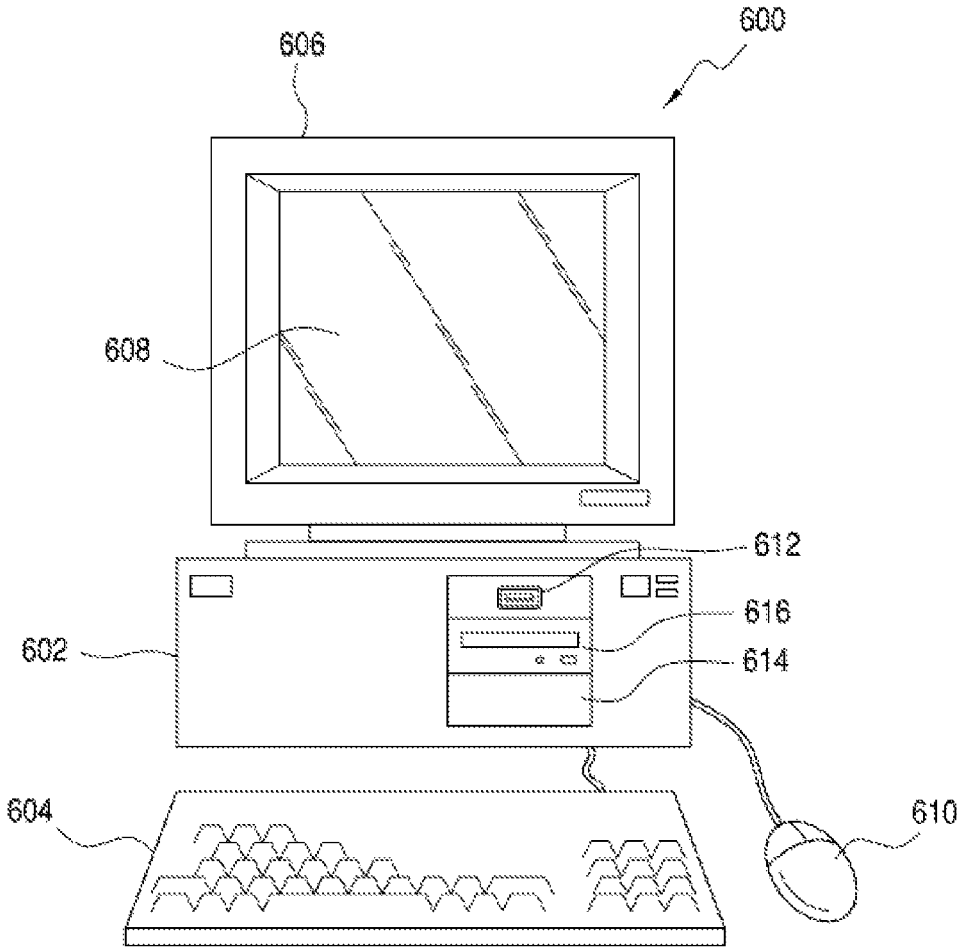
FIG. 1 is a front view of an example of a computer that, if appropriately programmed (e.g., as described herein), can be used to implement or can form various embodiments of the invention.

The drawings illustrate, among other things, examples of certain aspects of particular embodiments. Various embodiments may include aspects shown in the drawings, described in the specification (including the claims), shown or described in the documents that are incorporated by reference, known in the art, or a combination thereof, as examples. Other embodiments, however, may differ. Various methods include some or all of the acts illustrated in FIG. 3, described herein, or both, and a number of embodiments, include additional acts as well.

DETAILED DESCRIPTION OF EXAMPLES OF EMBODIMENTS

This patent application describes, among other things, examples of certain embodiments, and certain aspects thereof. Other embodiments may differ from the particular examples described in detail herein. Various embodiments are or concern apparatuses and methods for tracking railroad cars, for example, in transit, for instance, on one or more railroads, in one or more countries, or both. Certain embodiments are used to track shipment of petroleum products, such as oil, for example. In certain embodiments, at least one computer is used, methods are computer implemented, or both. In various embodiments, methods are tied to particular machines, such as computers that are configured (e.g., programmed with machine-readable instructions) to perform specific tasks or acts described here. Further, in a number of embodiments, methods are tied specifically to railroad cars, in that the methods are used for tracking these particular machines.

It is an aspect of some embodiments that a presentation device, such as a notebook computer, tablet computer, mobile phone, or a smart phone, presents an operator of the computer, for example, with input/output fields for managing the shipment of goods or commodities, for instance. Various embodiments include a selection means, such as a touch sensitive display, a touch/signature pad, a mouse, or another device that the user or operator can use to make selections, communicate with others, etc. In a number of embodiments, a software tool, computer program, or mobile app, as examples, is used. In various embodiments, the method or apparatus operates, in whole or in part, on one or more computers, which may include, for instance, one or more desktop computers, laptop computers, tablet computers, smart phones, mobile phones, mobile devices, servers, or a combination thereof, as examples. In some embodiments, the apparatus or method is network or web based, for example, and is accessed via one or more computers (e.g., as described herein), for example, in different embodiments, with or without using a mobile app or software installed on each computer or mobile device. In various embodiments, the method or apparatus can be used by different staff (e.g., administrators) so they have live up-to-date information, for example, at any time with which to make decisions, evaluate status and performance, etc.

FIG. 1 illustrates an exemplary embodiment of computer system 600, all of which or a portion of which can be suitable for implementing various techniques and methods described herein. Computer system 600, configured with certain machine-readable instructions described herein, is also an example of an apparatus as described herein. In other embodiments, a different or separate one of chassis 602 (e.g., and its internal components) can be suitable for implementing certain techniques described herein. Furthermore, one or more elements of computer system 600 (e.g., refreshing monitor 606, keyboard 604, and/or mouse 610, etc.) can also be appropriate for implementing particular techniques described herein. Computer system 600 comprises chassis 602 containing one or more circuit boards, Universal Serial Bus (USB) port 612, Compact Disc Read-Only Memory (CD-ROM) and/or Digital Video Disc (DVD) drive 616, and hard drive 614.

Figure 2:
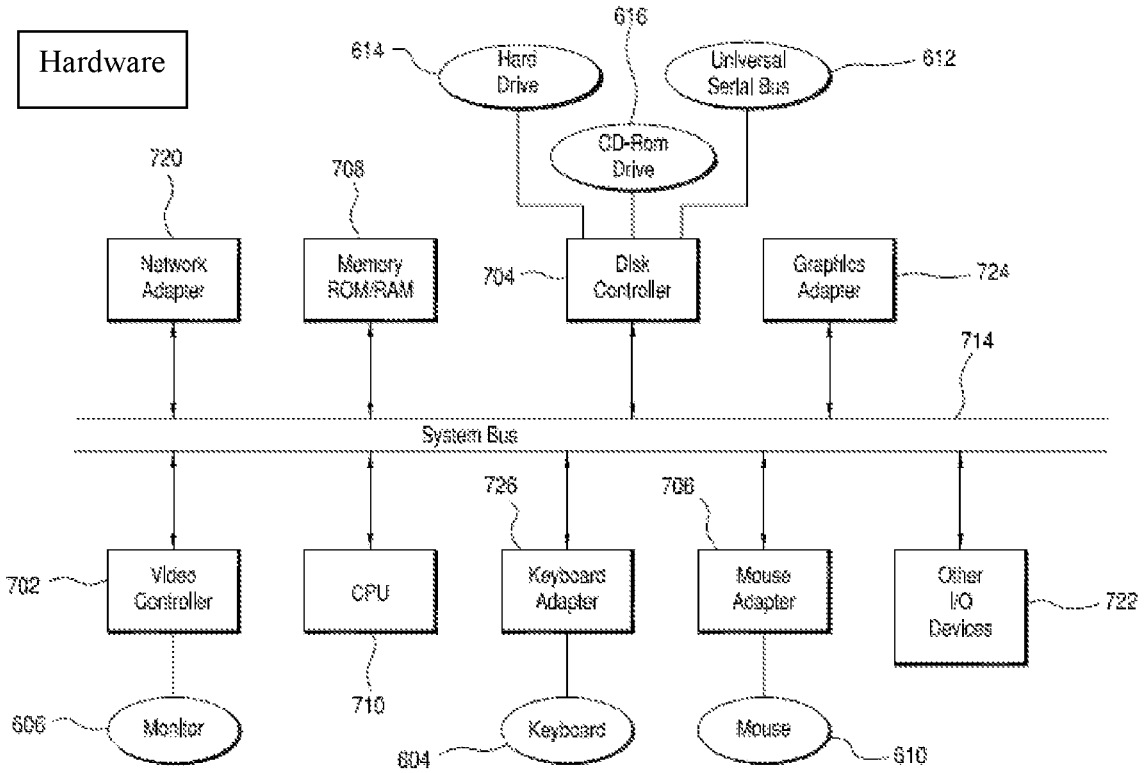
FIG. 2 is a block diagram illustrating an example of elements contained within the computer of FIG. 1.

A representative block diagram of the elements included on the circuit boards inside chassis 602 is shown in FIG. 2. Central processing unit (CPU) 710 in FIG. 2 is coupled to system bus 714 in FIG. 2. In various embodiments, the architecture of CPU 710 can be compliant with one or more of a variety of commercially distributed architecture families. In the embodiment illustrated in FIG. 2, system bus 714 is also coupled to memory storage unit 708, where memory storage unit 708 comprises, in this example, both read only memory (ROM) and random access memory (RAM). Non-volatile portions of memory storage unit 708 or the ROM can be encoded with a boot code sequence suitable for restoring computer system 600 (FIG. 1) to a functional state after a system reset. In addition, memory storage unit 708 can comprise microcode such as a Basic Input-Output System (BIOS). In some examples, the one or more memory storage units of the various embodiments disclosed herein can comprise memory storage unit 708, a USB-equipped electronic device, such as, an external memory storage unit coupled to universal serial bus (USB) port 612 (FIGS. 1-2), hard drive 614 (FIGS. 1-2), and/or CD-ROM or DVD drive 616 (FIGS. 1-2). In the same or different examples, the one or more memory storage units of the various embodiments disclosed herein can comprise an operating system, which can be a software program that manages the hardware and software resources of a computer and/or a computer network. The operating system can perform basic tasks such as, for example, controlling and allocating memory, prioritizing the processing of instructions, controlling input and output devices, facilitating networking, and managing files. Some examples of common operating systems can comprise Microsoft® Windows® operating system (OS), Mac® OS, UNIX® OS, and Linux® OS.

As used herein, "processor" and/or "processing module" means any type of computational circuit, such as but not limited to a microprocessor, a microcontroller, a controller, a complex instruction set computing (CISC) microprocessor, a reduced instruction set computing (RISC) microprocessor, a very long instruction word (VLIW) microprocessor, a graphics processor, a digital signal processor, or another type of processor or processing circuit capable of performing the desired functions. In some examples, the one or more processors of the various embodiments disclosed herein can comprise CPU 710.

In the embodiment depicted in FIG. 2, various I/O devices such as disk controller 704, graphics adapter 724, video controller 702, keyboard adapter 726, mouse adapter 706, network adapter 720, and other I/O devices 722 can be coupled to system bus 714. Keyboard adapter 726 and mouse adapter 706 are coupled to keyboard 604 (FIGS. 1-2) and mouse 610 (FIGS. 1-2), respectively, of computer system 600 (FIG. 1), in the embodiment illustrated. While graphics adapter 724 and video controller 702 are indicated as distinct units in FIG. 2, video controller 702 can be integrated into graphics adapter 724, or vice versa in other embodiments. Video controller 702 is suitable for refreshing monitor 606 (FIGS. 1-2) to display images on a screen 608 (FIG. 1) of computer system 600 (FIG. 1). Disk controller 704 can control hard drive 614 (FIGS. 1-2), USB port 612 (FIGS. 1-2), and CD-ROM drive 616 (FIGS. 1-2). In other embodiments, distinct units can be used to control each of these devices separately.

In some embodiments, network adapter 720 can include and/or be implemented as a WNIC (wireless network interface controller) card plugged or coupled to an expansion port in computer system 600 (FIG. 1). In other embodiments, the WNIC card can be a wireless network card built into computer system 600 (FIG. 1). A wireless network adapter can be built into computer system 600 by having wireless communication capabilities integrated into the motherboard chipset, or implemented via one or more dedicated wireless communication chips, connected through a PCI (peripheral component interconnector) or a PCI express bus of computer system 600 (FIG. 1) or USB port 612 (FIG. 1), as examples. In other embodiments, network adapter 720 can comprise and/or be implemented as a wired network interface controller card. Other components of computer system 600 (FIG. 1) and their interconnection are well known to those of ordinary skill in the art. When computer system 600 in FIG. 1 is running, program instructions stored on a USB-equipped electronic device connected to USB port 612, on a CD-ROM or DVD in CD-ROM and/or DVD drive 616, on hard drive 614, or in memory storage unit 708 (FIG. 2) are executed by CPU 710 (FIG. 2). A portion of the program instructions or machine-readable instructions stored on these devices can be suitable for carrying out at least part of the techniques described herein.

Although computer system 600 is illustrated as a desktop computer in FIG. 1, there can be examples where computer system 600 may take a different form while still having functional elements similar to those described for computer system 600. In some embodiments, computer system 600 may comprise a single computer, a single server, or a cluster or collection of computers or servers, or a cloud of computers or servers, as examples. Typically, a cluster or collection of servers can be used when the demand on computer system 600 exceeds the reasonable capability of a single server or computer. In various embodiments, the computer system is specifically configured with certain machine-readable instructions, that when executed (e.g., by the computer) perform certain novel and non-obvious acts.

Figure 3:
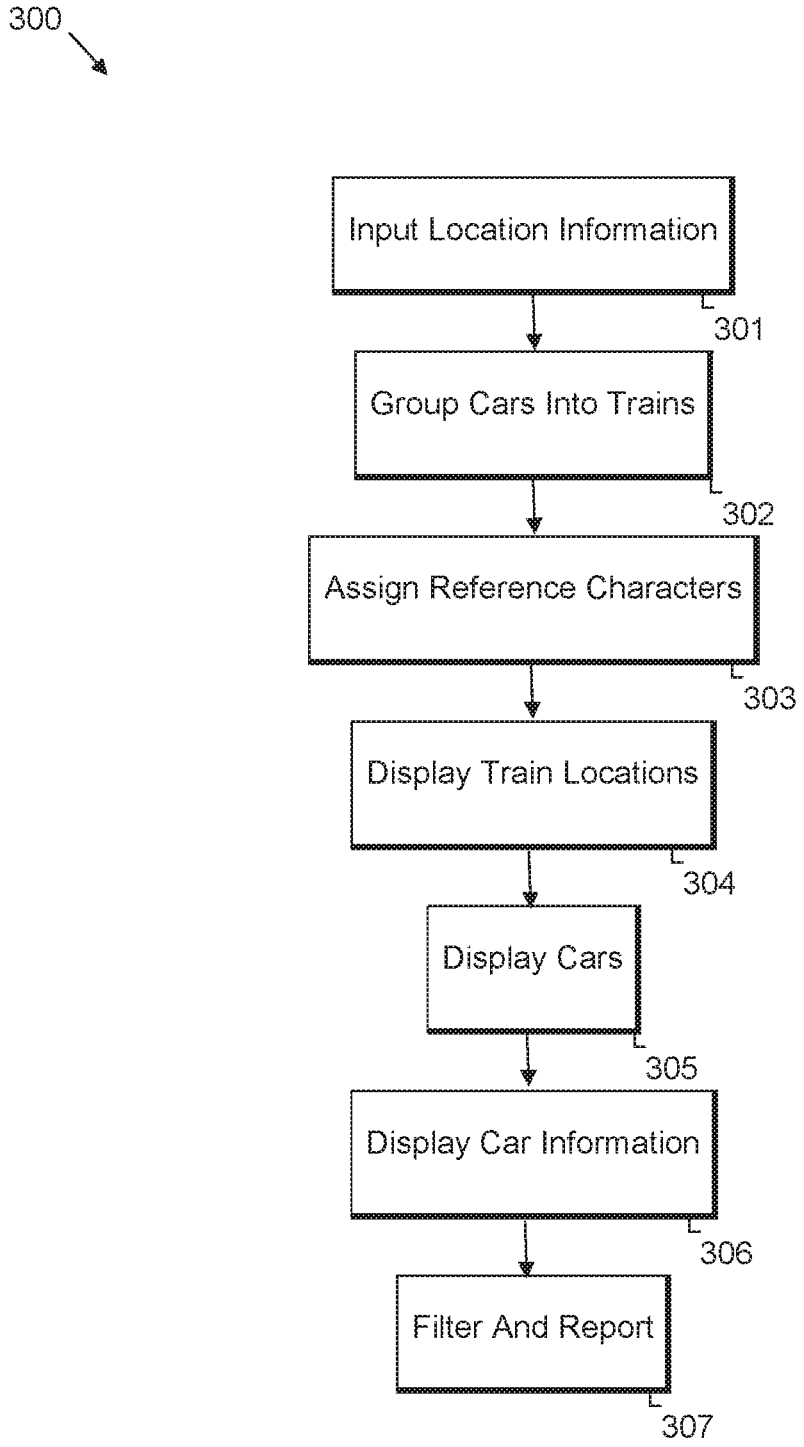
FIG. 3 is a flow chart illustrating an example of a computer-implemented method of tracking railroad cars during transit that can be implemented, for example, on the computer of FIGS. 1 and 2.

FIG. 3 illustrates an example of a computer-implemented method of tracking railroad cars during transit, method 300. A particular order is shown of the acts depicted in FIG. 3, which can be an example of an order in which such acts can be performed, but in other embodiments, acts can be performed in a different order. In a number of embodiments, various acts can be performed at the same time, and in some embodiments, acts can be repeated, for example, for different railroad cars or trains, for the same cars or trains, or both, for instance, at regular intervals, as data becomes available, or both.

Various embodiments include or use scanners (e.g., 431 and 432 shown in FIGS. 4 and 6), or information obtained from or produced by such scanners (e.g., information input in act 301 of method 300 illustrated in FIG. 3). In a number of embodiments, scanners (e.g., 431 and 432), for example, are positioned along the railroad tracks (e.g., 422), and scan each train car, for instance, as it passes by. The scanned information is collected, in some embodiments, by a service provider, from which organizations such as companies can buy services to obtain (e.g., in act 301) messages containing the scanned information. An example of such a service provider is Railinc Corporation. In a number of embodiments, the messages that contain the scanned information are called car location messages or CLMs. In particular embodiments, the CLMs contain GPS locations of the scanners (e.g., 431 and 432), other information about the trains and cars, or a combination thereof.

In a number of embodiments, CLMs, or the location information therein, are produced using an automatic equipment identification (AEI) tag or radio frequency identification (RFID) tag located, for instance, on each railroad car. In various embodiments, the tag does not contain and is not connected to a power source, but is energized by radio frequency energy received from the stationary reader or scanner (e.g., 431 or 432). Further, in a number of embodiments, CLMs are provided for multiple railroads, or all railroads within a country (e.g., the United States, for instance, 412 shown in FIGS. 4 and 6, for example, railroads 421 and 422), as examples. In a number of embodiments, an operator's entire fleet of railroad cars (e.g., within a country or on a continent) is displayed (e.g., in act 304 of method 300). Even further, in various embodiments, the act (e.g., 301) of inputting into the user computer real time location information for the railroad cars includes inputting into the user computer data obtained through a computer network, for example, the Internet, a mobile phone network, or both (e.g., both being examples of computer networks).

In some embodiments, a user of an embodiment may own, use, or lease hundreds of railroad cars, for example, and may receive (e.g., in act 301) about 10 car location messages per car per day, or about 300 CLMs per car per month. As a result, an automated method (e.g., 300) and apparatus for interpreting these CLMs can be very beneficial. Further, a railroad car carrying a shipment of oil, for example, can hold $70K worth of product, making the tracking fairly important, and delays significant. In addition, when a railroad car is bad ordered, it is important to identify the problem quickly and get the car repaired quickly so product in the car, or that the car was scheduled to pick up, is delivered in a timely manner.

Figure 4:
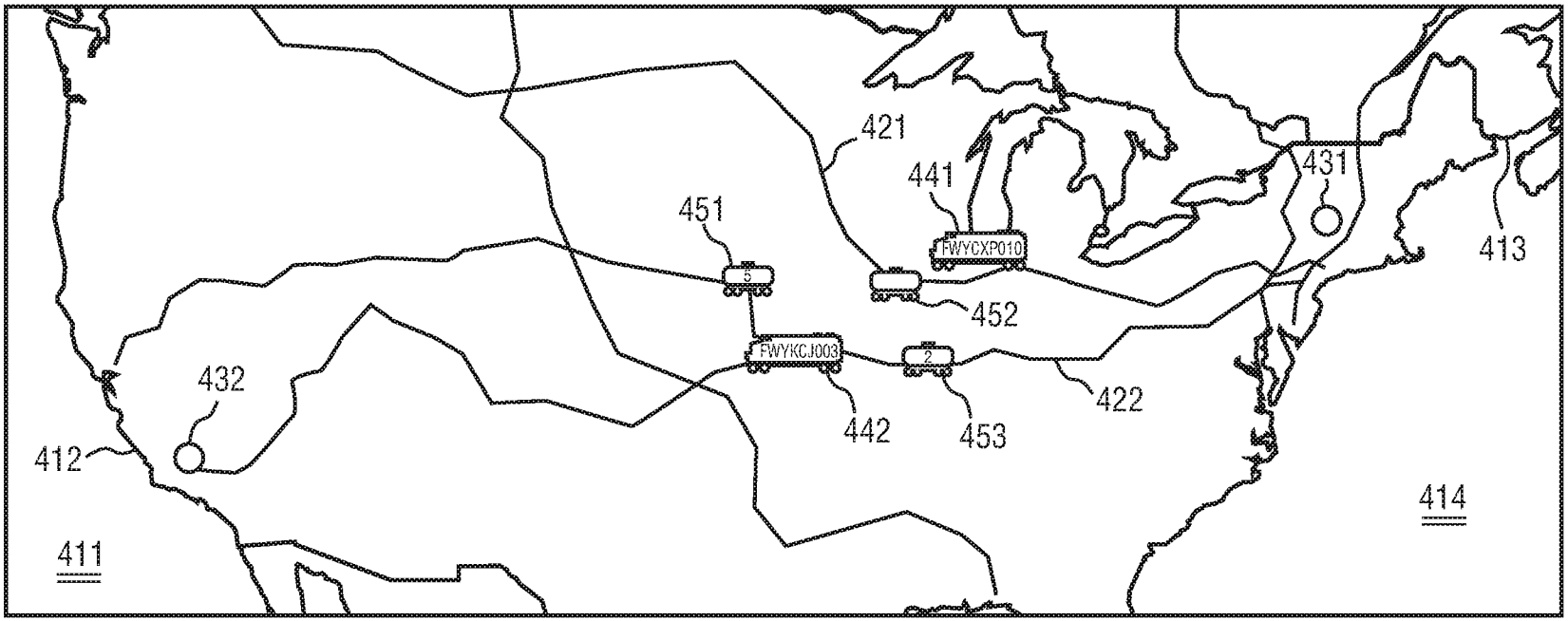
FIG. 4 is a screen shot illustrating an example of a display (e.g., a computer display) of locations of multiple trains on a graphical representation of a geographical region (in this illustration, the United States of America), wherein each of the multiple trains is represented on the geographical region by one of multiple train symbols, and railcar symbols are also displayed for individual railroad cars that are not coupled together to make up one of the multiple trains represented by the multiple train symbols.

In certain embodiments, the CLMs can be retrieved (e.g., in act 301) almost instantly, and in some embodiments, for example, using the GPS coordinates of the scanner (e.g., 431 or 432) in the CLM, the train's location can be plotted (e.g., in act 304), for example, on a map of the United States (e.g., 412), for instance, that has the rail lines (e.g., 421 and 422) overlaid on it. FIG. 4 is an example. In particular embodiments, using the train name, location, status, or a combination thereof, for example, individual railcars are grouped (e.g., in act 302 of method 300 shown in FIG. 3) into trains (e.g., by the software), for instance, when possible. This is used, in some embodiments, to simplify the display (e.g., in act 304), and represent the railcars as trains, which can be more aligned with the scheduler's thinking in many instances. In various embodiments, each railroad car is tracked and the different cars are assembled into a train (e.g., in act 302), for example, rather than using one or a few cars to represent a train and tracking just those cars. Tracking each car avoids problems that can occur if just one or a few cars in a train are being tracked and the one or few cars drops off the train. If just one or a few cars in a train are being tracked, and the one or few cars drops off the train, the tracking system can become blind to that train, but in embodiments where all cars are tracked, this problem cannot readily occur.

Further, in particular embodiments, the act (e.g., 304) of displaying locations of multiple trains includes displaying on a graphical representation of a continent (e.g., North America), displaying on a graphical representation of at least one country (e.g., the United States of America (e.g., 412 shown in FIGS. 4 and 6) or a combination of the United States of America, Canada (e.g., 413), and Mexico), or both. Moreover, in some embodiments, the act of displaying locations of multiple trains (e.g., 304) includes displaying a shape of a locomotive, for instance, for each of the multiple train symbols (e.g., 441 and 442 shown in FIG. 4). Furthermore, in some embodiments, the act (e.g., 304) of displaying locations of multiple trains includes displaying multiple rail lines (e.g., 421 and 422), for example, overlaid on the graphical representation of the geographical region (e.g., 412, 413, or both).

Figure 5:
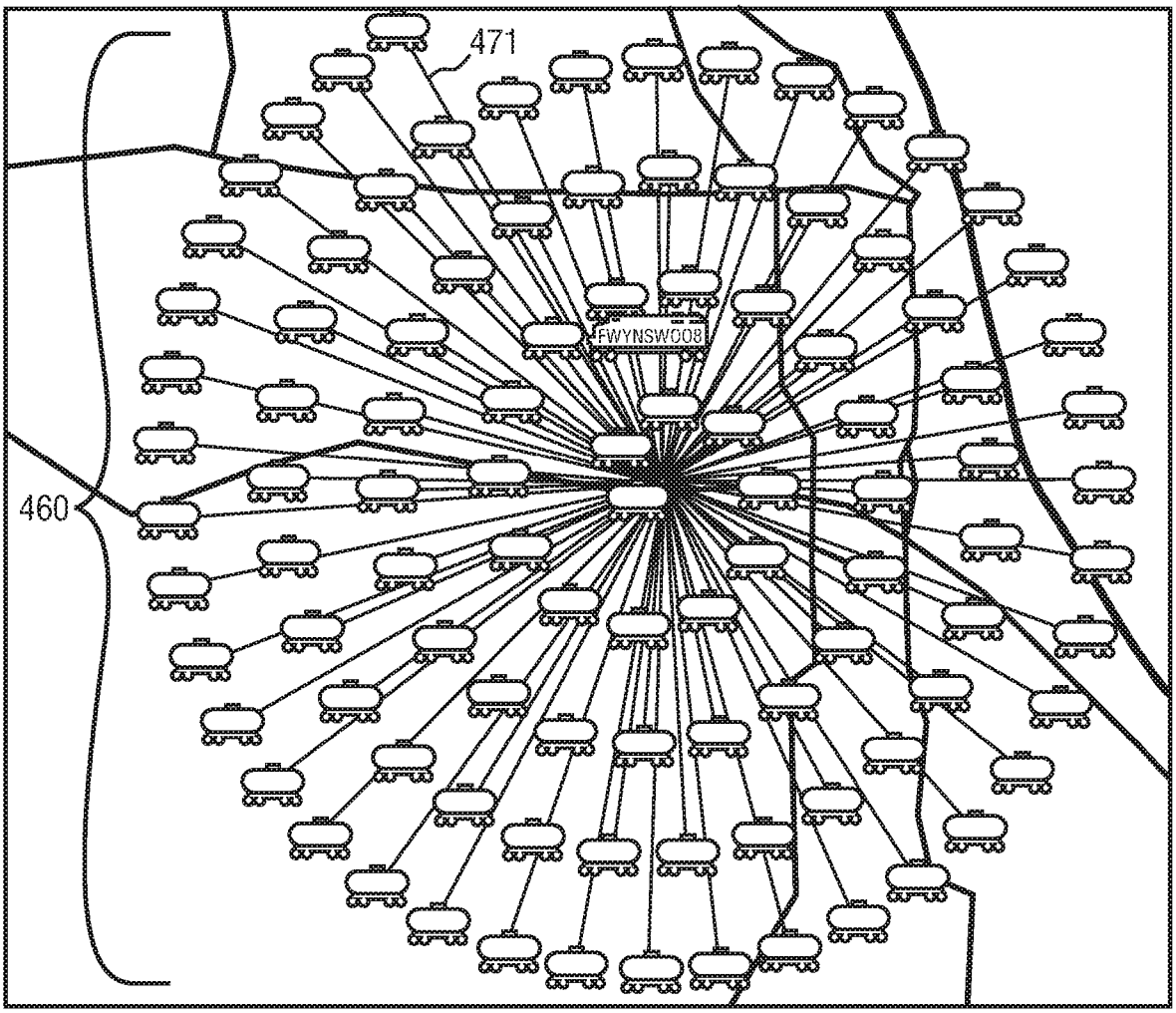
FIG. 5 is a screen shot illustrating and example of a display of one of multiple trains on a graphical representation of a geographical region (in this illustration, part of the United States of America, zoomed in from the geographical region of FIG. 1), wherein each railroad car of the train is represented on the geographical region by one of multiple railcar symbols, and wherein the railcar symbols are displayed in a spiral pattern.

Since there are normally one hundred or more cars on a train, in a number of embodiments, only a symbol of the train (e.g., train symbols 441 and 442 in FIG. 4) is shown on the map (e.g., 412, 413, or both, for instance, in act 304), but in some embodiments, when the train symbol (e.g., 441 or 442) is clicked on, symbols for railcars are displayed (e.g., in act 305 of method 300), for example, in a fan or spiral. An example of railcars for a train illustrated in a spiral is shown in FIG. 5, spiral 460. In various embodiments, there will be one railcar symbol (e.g., displayed in act 305, for instance, in spiral 460) for each car associated with the train (e.g., displayed in act 304). Another issue is that multiple trains can be close together or approximately at the same location, and would overlap or cover each other up if displayed (e.g., in act 304) in their actual location on the map (e.g., graphical representation of a geographical region, for instance, 412). This issue is resolved, in some embodiments, by shifting the train's placement, for instance, slightly (e.g., in act 304), for example, with a line connecting it to its actual position. FIG. 5 illustrates examples of such lines, one of which is identified by reference number 471. This allows multiple trains/railcars to be illustrated close together or approximately at the same location, and in a number of embodiments the users or operators can still interact with the symbols for more detail (e.g., click on the train symbol for information concerning the individual cars, for instance, displayed in act 305 or 306, that make up the train that is displayed in act 304).

Figure 6:
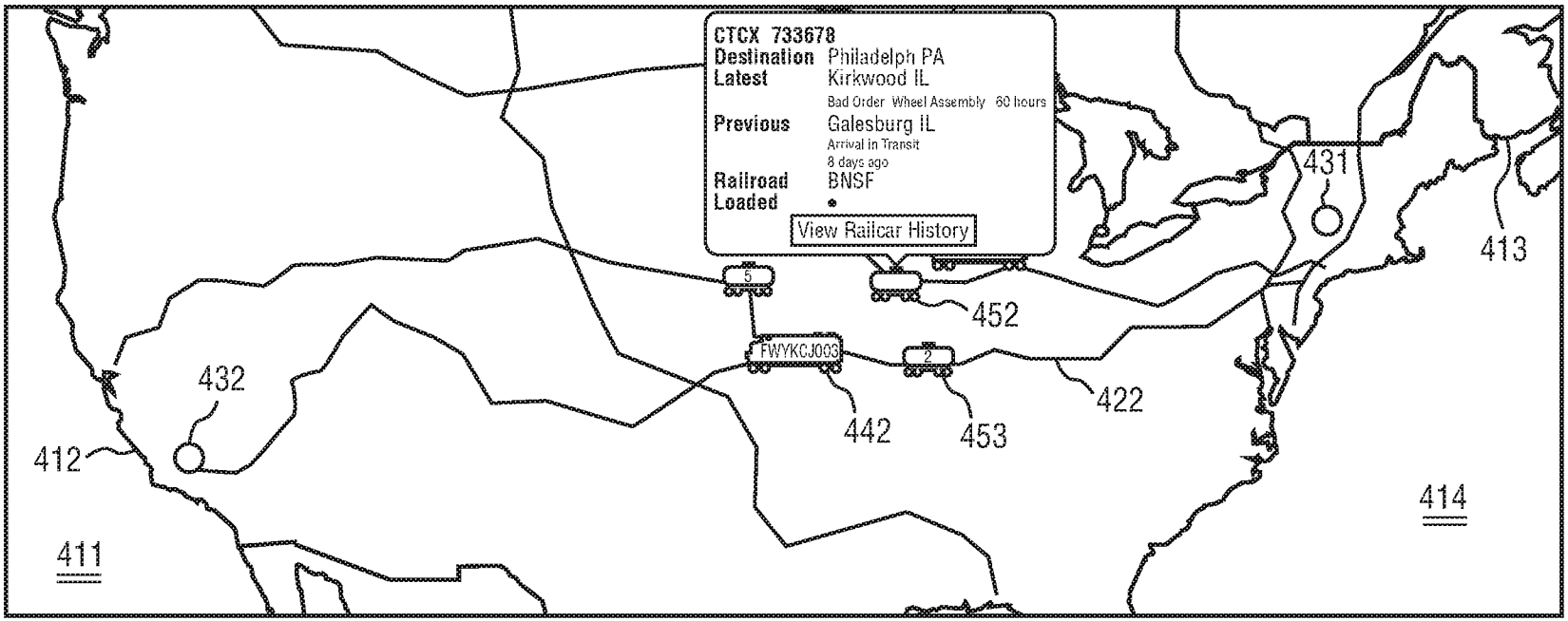
FIG. 6 is a screen shot illustrating a display of locations of multiple trains on a graphical representation of a geographical region (in this illustration, the United States of America), wherein a railcar symbol for a rail car with a problem (e.g., a bad ordered car) has been clicked on and additional details about the issue with the car are displayed.

Some embodiments include changing colors, for example, of the multiple train symbols, depending on status of the railroad cars within the train. In a number of embodiments, for instance, the train symbol (e.g., 441 or 442 for instance, displayed in act 304) will change to different colors depending on the status of the cars (e.g., grouped into the train in act 302) that are associated with the train. When there is a problem, for example, the train symbol (e.g., displayed in act 304) will change, in a number of embodiments, to a color that shows what type of problem there is. The train symbol (e.g., 441 or 442) can then be clicked on, in some embodiments, to see which car has an issue (e.g., to display the cars in act 305, for instance, as shown in FIG. 5). The car that has the problem will have a color (e.g., displayed in act 305) representing the problem, in some embodiments, and can be clicked on to see details about the issue (e.g., displayed in act 306 of method 300 shown in FIG. 3) in certain embodiments. An example of the display of details for railcar 452 is shown in FIG. 6. In particular embodiments, for example, the following are the colors that a train (e.g., displayed in act 304) and train cars (e.g., displayed in act 305) will turn:

White—The car (e.g., displayed in act 305) is empty, and has a "normal" status;

Black—The car (e.g., displayed in act 305) is full, and has a "normal" status;

Red—The car (e.g., displayed in act 305) was bad ordered, held, or, in some embodiments has another serious issue (e.g., 452);

Orange—The car (e.g., displayed in act 305) has not moved for some time, or has a status that may need to be reviewed;

Green—The train (e.g., displayed in act 304) or car (e.g., displayed in act 304 or 305) has been released from being bad ordered; and Rainbow—The train (e.g., displayed in act 304) has multiple cars with different statuses.

In various embodiments, cars that are bad ordered (e.g., 452) will turn red (e.g., displayed in act 305), will be dropped off the trains they were on, or both, but the history of the car (e.g., displayed in act 306), in a number of embodiments, will remain available through the train (e.g., 442) that the bad ordered car (e.g., 452) started out with. In some embodiments, the car will be shown (e.g., in act 304) at the last CLM's GPS location to show approximately where the car is, for example, in the United States (e.g., 412 shown in. FIGS. 4 and 6). The car (e.g., 452) can be clicked on, in a number of embodiments, to see information (e.g., displayed in act 306, for example, shown in FIG. 6) on the bad order, for instance, so the schedulers can call to make sure the car is fixed in a timely manner. Further, in a number of embodiments, history information of the trains, cars (e.g., displayed in act 306), or both, will be kept for reporting purposes (e.g., in act 307). History information can include, for example, where the car or train, has been, equipment problems, etc. In some embodiments, CLMs are archived so the system does not slow down the application because of the volume of CLMs collected. In a number of embodiments, various reports (e.g., in act 307) can be used to help track the trains (e.g., 441 and 442) and cars (e.g., 451, 452, and 453), for example, that can be access through a (e.g., main) menu in some embodiments.

As mentioned, various embodiments include certain computer-implemented methods (e.g., 300 shown in FIG. 3), for example, of tracking railroad cars, for instance, during transit. In a number of embodiments, the methods include, for example, in any order, at least certain acts. Further, in various embodiments, such acts include, for instance, inputting (e.g., in act 301), for example, into a user computer, real time location information for the railroad cars. In some embodiments, CLMs, for example, are input into the computer, or are used by the computer, for instance, each minute, two minutes, three minutes, four minutes, five minutes, six minutes, seven minutes, eight minutes, nine minutes, ten minutes, 12 minutes, 15 minutes, 20 minutes, 30 minutes, 45 minutes, or 60 minutes, as examples. As used herein, information that is an hour or less old (e.g., when it is first displayed in act 304) is considered to be real time information.

In a number of embodiments, for example, the location information (e.g., input in act 301) is obtained from multiple sensors (e.g., CLM readers, for instance, 431 and 432 shown in FIGS. 4 and 6), for instance, through at least one computer network. Further still, various embodiments include, for example, using the user computer, using the real time location information for the railroad cars, or both, displaying locations (e.g., in act 304), for example, of multiple trains, for instance, on a graphical representation of a geographical region (e.g., 412 shown in FIGS. 4 and 6), for example, on a computer display. Even further, in a number of embodiments, each of the multiple trains includes at least one of the railroad cars. Moreover, in various embodiments, each of the multiple trains is represented on the geographical region (e.g., 412, for instance, in act 304) by one of multiple train symbols (e.g., 441 or 442).

In a number of embodiments, when an operator, for example, of the user computer (e.g., 600) selects (e.g., clicks on) one of the multiple train symbols (e.g., 441 or 442, for example, displayed in act 304), for instance, an act is performed of displaying (e.g., on the geographical region, for instance, 412, or part thereof), for example, one railcar symbol (e.g., in act 305) for each of multiple of the railroad cars that make up one of the multiple trains represented by the one of the multiple train symbols (e.g., in act 304). Further, in various embodiments, multiple railcar symbols (e.g., images of a railroad car are displayed (e.g., in act 305) for the one of the multiple trains. FIG. 5 illustrates an example. Still further, some embodiments include (e.g., in addition or instead), using the user computer (e.g., 600), using the real time location information for the railroad cars (e.g., input in act 301), or both, to determine (e.g., in act 302) how the railroad cars are grouped into the multiple trains, for instance, for the act of displaying (e.g., in act 304) locations of multiple trains. Even further, some embodiments include, for example, using the user computer, assigning a reference character (e.g., act 303 of method 300 shown in FIG. 3) to each of the multiple trains (e.g., displayed in act 304). For example, train symbols 441 and 442 in FIG. 4 contain reference characters FWYCXP010 and FWYKCJ003.

In particular embodiments, when two of the multiple trains are close together, for example, an act (e.g., in act 304) is performed of displaying, for instance, at least one of the two of the multiple train symbols (e.g., on the graphical representation of the geographical region, for instance, 412) at a shifted location, for example, with a line (e.g., similar to line 471 shown in FIG. 5) connecting the at least one of the two of the multiple train symbols to an actual position of the train. Further, some embodiments include changing colors (e.g., in act 304), for example, of the multiple train symbols (e.g., 441 or 442), for instance, depending on status of the railroad cars within the train. Still further, some embodiments include an act of displaying history information (e.g., in act 306) for a railroad car, for example, that is bad ordered (e.g., 452), has been dropped off a particular one of the multiple trains, or both. In certain embodiments, for example, this information is displayed when a train symbol (e.g., displayed in act 304, for example, 441) is selected by an operator of the user computer for the train that the railroad car (e.g., 452) that is bad ordered was on before being dropped off the train.

Particular embodiments include, for example, depicting on the geographical region (e.g., 412) a bad ordered car (e.g., one of the railroad cars, for instance, in act 304, 305, or both, for instance, car 452). In a number of embodiments, the bad ordered car is depicted at a last (e.g., most recent) position of the location information received (e.g., in act 301) for the bad ordered, car. Further, some embodiments include displaying (e.g., in act 304) a location of a particular train in an ocean (e.g., 411 or 414, for example, adjacent to the land depicted in the graphical representation of the geographical region (e.g., 412), for instance, displayed in act 304) when the location information (e.g., GPS coordinates, for instance, normally input in act 301) is unavailable for that particular train. Still further, in some embodiments, when a bad ordered railroad car (e.g., 452) is separated from one of the multiple trains (e.g., 441), an act is (or acts are) performed of displaying a train symbol (e.g., 441) for the train (e.g., in act 304) and a railcar symbol (e.g., 452, for instance, in act 304, 305, or both) for the bad ordered railroad car (e.g., depicted in red). Even further, in some such embodiments, the train symbol (e.g., (e.g., 441 and 442 displayed in act 304) and the railcar symbol (i.e., for the railcar that left that train, for instance, displayed in act 304 or 305) each have a common reference character (e.g., FWYCXP010 or FWYKCJ003, for instance, the reference character or number for the train prior to the bad ordered railroad car being separated from or dropped off of the train, for instance, assigned in act 303).

As mentioned, some embodiments include an act of (e.g., using the user computer) assigning a reference character (e.g., FWYCXP010 or FWYKCJ003) to each of the multiple trains (e.g., act 303). In certain embodiments, for instance, the reference character is unique for each of the multiple trains. Further, in some embodiments, each reference character includes a reference number. Still further, in particular embodiments, the reference number is unique for each of the multiple trains (e.g., displayed in act 304). Even further, in some embodiments, the act of displaying locations of multiple trains (e.g., act 304) includes displaying the reference character for each of the multiple trains (e.g., a different reference character for each train, for instance, as shown in FIG. 4). Further still, in some embodiments, the act (e.g., act 304) of displaying locations of multiple trains includes displaying one reference character within each one of the multiple train symbols (e.g., train symbols 441 and 442 contain reference characters FWYCXP010 and FWYKCJ003 in FIG. 4). In certain embodiments, for example, the reference character is a BNSF (Burlington Northern and Santa Fe Railway) number that, in a number of embodiments, is retained even if the railroad car is traveling on another railroad.

As stated above, in some embodiments, when two of the multiple trains are close together (e.g., close enough together that the train symbols (e.g., 441 and 442) would overlap otherwise, or overlap by 5, 10, 20, 30, 40, 50, 60, 70, 80, or 90 percent, or more, as examples, in different embodiments), at least one of the two of the multiple train symbols is shown (e.g., act 304) on the graphical representation of the geographical region (e.g., 412) at a shifted location with a line (e.g., similar to line 471 shown in FIG. 5) connecting the at least one of the two of the multiple train symbols to an actual position of the train. In some embodiments, both of the multiple train symbols are shown (e.g., act 304) on the graphical representation of the geographical region (e.g., 412) at a shifted location with a line connecting each of the two train symbols to an actual position of the train, while in other embodiments, only one of the two train symbols is shown on the graphical representation of the geographical region (e.g., 412) at a shifted location with a line connecting the one train symbol to the actual position of the train, while the other train symbol is shown (e.g., act 304) at the actual position of the train. Even further, in some embodiments, when more than two of the multiple trains are close together, at least two, all but one, or all of the more than two of the multiple train symbols are shown on the graphical representation of the geographical region (e.g., 412, for instance, in act 304) at a (e.g., different, unique, or unoccupied) shifted location with a line connecting the shifted train symbols to an actual position of the corresponding train.

As mentioned previously, some embodiments include, for example, changing colors of the multiple train symbols (e.g., 441 or 442 for instance, or in FIG. 5, for example, displayed in act 304) depending on status of the railroad cars within the train. Even further, in some embodiments, the act (e.g., act 305) of displaying railcar symbols (e.g., one railcar symbol for each of multiple of the railroad cars that make up one of the multiple trains represented by the one of the multiple train symbols displayed in act 304, for instance, in FIG. 5) includes indicating status of each of multiple of the railroad cars. Still further, in some embodiments, the act of displaying the railcar symbols (e.g., act 305) includes indicating status of each of multiple of the railroad cars through the color of the railcar symbol.

In some embodiments, for example, a first color railcar symbol (e.g., in act 305) indicates that the railroad car is empty and has a normal status. For instance, in certain embodiments, a white railcar symbol indicates that the railroad car is empty and has a normal status. Further, in some embodiments, a second color railcar symbol indicates that the railroad car is full and has a normal status. For instance, in certain embodiments, a black railcar symbol indicates that the railroad car is full and has a normal status. Still further, in some embodiments, a third color railcar symbol indicates that the railroad car is bad ordered (e.g., in act 304 or 305). For instance, in certain embodiments, a red railcar symbol indicates that the railroad car (e.g., 452) is bad ordered. Further still, in some embodiments, a fourth color railcar symbol (e.g., in act 304 or 305) indicates that the railroad car has not moved in a particular period of time. For instance, in certain embodiments, an orange railcar symbol indicates that the railroad car has not moved in a particular period of time. Even further, in particular embodiments, a yellow railcar symbol (e.g., in act 304 or 305) indicates that the railroad car has not moved in a particular period of time. Even further still, in some embodiments, an orange railcar symbol indicates that the railroad car has not moved in a first period of time and a yellow railcar symbol indicates that the railroad car has not moved in a second period of time (e.g., where the second period of time is different than the first period of time).

For example, in some embodiments, the particular period of time (i.e., that the railroad car, for instance, 452, has not moved) is between one and four days. Further, in certain embodiments, the particular period of time is between two and three days. Still further, in particular embodiments, the particular period of time is two days or is three days, as examples. Even further, in some embodiments, a fifth color railcar symbol (e.g., displayed in act 304 or 305) indicates that the railroad car has been released from being bad ordered. For instance, in certain embodiments, a green railcar symbol indicates that the railroad car has been released from being bad ordered. Further still, in some embodiments, a sixth color train symbol (e.g., in act 304) indicates that the train has different cars with different statuses. For instance, in certain embodiments, a multi-color train symbol or a rainbow color train symbol, as examples, indicates that the train has different cars with different statuses. In a number of embodiments, as mentioned, an operator can select or click on a rainbow color train (e.g., displayed in act 304), for instance, to get information on or the status of each car of the train (e.g., in act 305, 306, or both).

In various embodiments, a railroad car (e.g., 452) that is bad ordered is dropped off the train that it the railroad car that is bad ordered) was on, but history information for the railroad car (i.e., that is bad ordered) remains accessible (e.g., is displayed in act 306) by selecting (e.g., clicking on) the train symbol (e.g., 441, for instance, in act 304) for the train that it (i.e., the railroad car that is bad ordered) was on. Further, some embodiments include an act of displaying history information (e.g., in act 306) for a railroad car that is bad ordered (e.g., 452) and has been dropped off a particular one of the multiple trains. In particular embodiments, the history information (e.g., shown in FIG. 6) is displayed, for example, when a train symbol (e.g., displayed in act 304) is selected (e.g., clicked on) by an operator of the user computer (e.g., 600). The selected train symbol (e.g., 441) may be, for example, for the train that the railroad car (e.g., 452) that is bad ordered was on before being dropped off the train. Still further, some embodiments include an act of displaying (e.g., in act 306) additional information for a particular railroad car when the railcar symbol (e.g., 453, for instance, displayed in act 304 or 305) for the particular railroad car is selected by the operator of the user computer.

Various embodiments include an act of providing reports (e.g., act 307) for railroad cars, for example, based on status of the railroad cars. For example, in some embodiments, a report of bad ordered cars can be provided (e.g., in act 307). Moreover, in a number of embodiments, an operator can track the types of bad orders (e.g., filtered and reported in act 307) and take steps to reduce the number of bad ordered cars. Further, as mentioned, in some embodiments, a railcar symbol (e.g., displayed in act 304 or 305) for a railroad car (e.g., 452) that is bad ordered can be selected (e.g., clicked on) to see additional information (e.g., displayed in act 306) concerning the bad order for the railroad car that is bad ordered. Further still, in a number of embodiments, when an operator of the user computer selects one of the multiple train symbols (e.g., 441 or 442, for example, displayed in act 304), the method includes zooming in (e.g., in act 304 or 305) to a portion of the geographical region (e.g., 412). In some embodiments, for example, selecting (e.g., clicking on) a train symbol (e.g., displayed in act 304) once zooms in on the location of the train, and selecting the train symbol (e.g., 441 or 442) a second time shows (e.g., in act 305) the individual cars in the train (e.g., in a spiral pattern, for instance, 460). Even further, some embodiments, include an act of providing, a history of a train (e.g., when the train is selected, hovered over, or clicked on, as examples, for instance, in FIG. 6).

Certain embodiments include acts that take place outside a computer (e.g., outside the user computer). For example, some embodiments include an act of repairing bad ordered cars. Further, some embodiments include an act of instructing a third party (e.g., a railroad or contractor) to repair one or more bad ordered cars. In a number of embodiments, such acts can lead to bad ordered cars being repaired and returned to service more quickly, which can result in the goods or commodities being delivered more quickly. Timely and efficient repair of bad ordered cars can reduce losses and improve profits. Even further, in a number of embodiments, railroad cars are transformed from a state of being bad ordered to a state of being repaired. Still further, in a number of embodiments, railroad cars are transformed from a state of being unusable to a state of being used for the shipment or transportation of goods or commodities (e.g., oil). Moreover, in a number of embodiments, railroad cars are transformed from a state of being held (e.g., stationary) to a state of being in transit or in service, for example, in the shipment of goods or commodities (e.g., oil). Thus, in various embodiments, methods and apparatuses described herein are transformative and transform materials of transportation from one state into another, as well as being tied to a particular machine (e.g., railroad cars and computers particularly configured to perform the acts recited herein). Even further, in certain embodiments, the methods and apparatuses described herein play a significant role in the transformation of oil into energy, products, or both.

Still further, a number of embodiments include an act of tracking repairs made to bad ordered cars, for instance, involving act 307. For example, some embodiments include an act of tracking problems that cause bad ordered cars. Even further, some embodiments include an act of filtering (e.g., in act 307) to show only bad ordered and held cars (e.g., overlaid on the graphical representation of the geographical region, for instance, 412). For instance, in some embodiments, (e.g., in act 307) trains, railcars, or both, that are not bad ordered or held, are removed from the display or from the graphical representation of the geographical region (e.g., 412), leaving (e.g., reporting) only the bad ordered cars (e.g., 452) and held cars (i.e., cars that have not moved in a particular period of time). Certain embodiments include an act (e.g., 307) of filtering to show (e.g., report) only bad ordered cars (e.g., 452). Further still, particular embodiments include an act of filtering (e.g., 307) to show only held cars. In various embodiments, the operator or user can control whether such filtering takes place.

As previously described, in some embodiments, the act of displaying locations of multiple trains (e.g., 304) includes displaying a location of a particular train in an ocean (e.g., 411 or 414) if location information (e.g., GPS coordinates which may usually be input in act 301) is unavailable for the particular train. This alerts the operator that the location information is unavailable or unknown rather than displaying the train symbol somewhere on the land or on the railroad tracks (e.g., 441 or 422) wherein the operator may be misled into believing that the train is in the location shown. Further, some embodiments include an act of displaying a location of a particular train (e.g., displaying a train symbol, for example, 441 or 442) on the graphical representation of the geographical region (e.g., 412), for example, in act 304) in an ocean (e.g., 411 or 414) when location information is unavailable for the particular train. In various embodiments, a train symbol is shown (e.g., in act 304) outside of the geographical region (e.g., 412) or land if location information is unavailable for that train (e.g., for the CLM data). Further, some embodiments, include an act of displaying a location of a particular railroad car (e.g., a railcar symbol, for instance, in act 304 or 305) outside the graphical representation of the geographical region (e.g., 412), or in an ocean (e.g., 411 or 414), for example, if location information is unavailable for the particular railroad car.

Further, in some embodiments, the act of displaying locations of multiple trains (e.g., 304) includes, when a bad ordered railroad car is separated from one of the multiple trains, displaying a train symbol (e.g., 441) for the train and a railcar symbol (e.g., 452) for the bad ordered railroad car (e.g., on the graphical representation of the geographical region, for instance, 412). Still further, in some embodiments, the train symbol and the railcar symbol each have a common reference character (e.g., a multiple-digit reference number, for instance, within each symbol). Even further, in a number of embodiments, the act of displaying one railcar symbol for each of multiple of the railroad cars that make up one of the multiple trains (e.g., 305) includes displaying a shape of a railroad car (e.g., a railroad tank car, for instance, used to transport oil, for instance, 451, 452, or 453 shown in FIG. 4, or as shown in FIG. 5) for each of the multiple of the railroad cars that make up one of the multiple trains. Further still, in some embodiments, the act (e.g., 305) of displaying one railcar symbol for each of multiple of the railroad cars that make up one of the multiple trains includes displaying the multiple railcar symbols in a spiral pattern (e.g., 460 shown in FIG. 5). Even further still, in particular embodiments, the act of displaying one railcar symbol for each of multiple of the railroad cars that make up one of the multiple trains is accomplished when an operator of the user computer selects or clicks on one of the multiple train symbols (e.g., displayed in act 304 for example, shown in FIG. 5). In certain embodiments, this occurs the second time the operator selects or clicks on the train symbol (e.g., 441 or 442), and the first time the operator selects or clicks on the train symbol (e.g., 441 or 442) the display zooms in on the area surrounding the train. Moreover, in various embodiments, the act of displaying one railcar symbol for each of multiple of the railroad cars that make up one of the multiple trains (e.g., 305) includes displaying one railcar symbol for each of the railroad cars in the train (e.g., as shown in FIG. 5).

Further embodiments include various apparatuses for tracking railroad cars during transit. Such an apparatus can include, for example, at least one computer (e.g., the user computer or another computer described herein, for instance, computer system 600) that includes machine-readable instructions that, when executed by the computer, perform at least one method (e.g., 300) described herein or comprising a combination of the acts or steps described herein. In a number of embodiments such instructions specifically configure and adapt the computer to perform such a method, acts, or steps.

Certain embodiments include, for example, an apparatus for tracking railroad cars during transit, the apparatus including at least one computer including machine-readable instructions that, when executed by the computer, input real time location information for the railroad cars (e.g., perform act 301), wherein the location information is obtained from multiple sensors (e.g., CLM sensors, for instance, 431 or 432 shown in FIGS. 4 and 6), for instance, through at least one computer network (e.g., the Internet). Particular embodiments, using the real time location information for the railroad cars, for example, display locations of multiple trains on a graphical representation of a geographical region (e.g., 412, for instance, performing act 304), each of the multiple trains including at least one of the railroad cars. Moreover, in a number of embodiments, each of the multiple trains is represented on the geographical region (e.g., 412) by one of multiple train symbols (e.g., 441 or 442). Further, in some embodiments, when an operator of the computer selects one of the multiple train symbols (e.g., 441 or 442), the apparatus displays one railcar symbol (e.g., act 305), for example, for each of multiple of the railroad cars that make up one of the multiple trains represented by the one of the multiple train symbols (e.g., as shown in FIG. 5). Still further, in various embodiments, multiple railcar symbols are displayed, for example, for the one of the multiple trains.

Further embodiments include an apparatus for tracking railroad cars during transit, the apparatus including at least one computer having machine-readable instructions that, when executed by the computer, use the real time location information for the railroad cars, for instance, to determine (e.g., in act 302) how the railroad cars are grouped into the multiple trains. In various embodiments, this determination is used, for example, for displaying locations of multiple trains. Moreover, some embodiments, for example, assign a reference character (e.g., number, for instance, FWYCXP010 or FWYKCJ003 in FIG. 4) to each of the multiple trains (e.g., in act 303). Furthermore, some embodiments, using the real time location information for the railroad cars, for example, display locations of multiple trains on a graphical representation of a geographical region (e.g., act 304), each of the multiple trains including at least one of the railroad cars, wherein each of the multiple trains is represented on the geographical region (e.g., 412) by one of multiple train symbols (e.g., 441 or 442), and in some embodiments, when two of the multiple trains are close together, display at least one of the two of the multiple train symbols on the graphical representation of the geographical region (e.g., 412) at a shifted location with a line (e.g., similar to line 471 shown in FIG. 5) connecting the at least one of the two of the multiple train symbols to an actual position of the train.

Still further, in a number of embodiments, an apparatus for tracking railroad cars during transit includes at least one computer having machine-readable instructions that, when executed by the computer, inputs real time location information for the railroad cars (e.g., from multiple sensors, for instance, 431 and 432, through a computer network, for instance, in act 301), displays locations of multiple trains on a graphical representation of a geographical region (e.g., represented by one of multiple train symbols, for instance, 441 or 442, for example, in act 304), and changes colors (e.g., of the multiple train symbols), for instance, depending on status of the railroad cars within the train. In the alternative, or in addition, some embodiments, display history information for a railroad car that is bad ordered and has been dropped off a particular one of the multiple trains when a train symbol (e.g., 441 or 442) is selected (e.g., clicked on)

by an operator of the at least one computer for the train that the railroad car that is bad ordered was on before being dropped off the train (e.g., in act 306). Moreover, some embodiments depict on the geographical region (e.g., 412) a bad ordered car (e.g., 452), the bad ordered car being one of the railroad cars, the bad ordered car being depicted (e.g., in act 304) at a last position of the location information received for the bad ordered car.

Furthermore, some embodiments of apparatuses display a location of a particular train in an ocean (e.g., 411 or 414) when the location information is unavailable for the particular train (e.g., in act 304). Still further, in certain embodiments, when a bad ordered railroad car is separated from one of the multiple trains, the apparatus displays a train symbol (e.g., 441 or 442) for the train and a railcar symbol (e.g., 452) for the bad ordered railroad car (e.g., in act 304). Even further, in particular embodiments, the train symbol and the railcar symbol each have a common reference character (e.g., reference number). Further still, in various embodiments, the apparatus (e.g., the at least one computer) includes machine-readable instructions that, when executed by the computer, perform a combination (e.g., any feasible combination) of the previously described methods or acts or steps thereof.

In various embodiments of a method or apparatus, the railroad cars are used to ship petroleum products. Further, in a number of embodiments, the railroad cars are used to ship oil, multiple of the railroad cars contain a load of oil, or both. Other railroad cars, in various embodiments, may be empty at any given time. Further still, in some embodiments, the method or apparatus is used to decide which cars are put together into a train, where the trains go, which tracks (e.g., 421 or 422 shown in FIG. 4) the trains use, or a combination thereof, as examples. Other embodiments, however, may lack such features or capability to direct assembly of trains or select routes. In some embodiments, for example, the method or apparatus plays no direct role on the railroad other than, for example, providing a mechanism for railroad customers to monitor railroad cars and encourage the railroad to repair bad ordered cars and move the cars in an efficient and timely manner.

Further, various embodiments of the subject matter described herein include various combinations of the acts, structure, components, and features described herein, shown in the drawings, described in documents that are incorporated by reference herein, or that are known in the art. Moreover, certain procedures can include acts such as manufacturing, obtaining, or providing components that perform functions described herein or in the documents that are incorporated by reference. The subject matter described herein also includes various means for accomplishing the various functions or acts described herein, in the documents that are incorporated by reference (if any), or that are apparent from the structure and acts described. Each function described herein is also contemplated as a means for accomplishing that function, or where appropriate, as a step for accomplishing that function.

Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

What is claimed is:

1. A computer-implemented method of tracking railroad cars during transit, the method comprising, in any order, at least the acts of:

inputting into a computer system, through at least one computer network, location information for the railroad cars, wherein the location information is obtained from multiple scanners that are positioned along railroad tracks that scan the railroad cars as the railroad cars pass by the multiple scanners;

using the computer system, using the location information for the railroad cars to determine how the railroad cars are grouped into multiple trains; and using the computer system and using the location information for the railroad cars, displaying locations of the multiple trains on a graphical representation of a geographical region, each of the multiple trains including at least one of the railroad cars, wherein each of the multiple trains is represented on the geographical region by one of multiple train symbols.

2. The computer-implemented method of claim 1 comprising inputting into the computer system GPS coordinates of the multiple scanners and using the GPS coordinates of the multiple scanners for the displaying of the locations of the multiple trains on the graphical representation of the geographical region.

3. The computer-implemented method of claim 1 wherein the act of displaying the locations of the multiple trains comprises displaying on a graphical representation of at least one country.

4. The computer-implemented method of claim 1 wherein the act of displaying the locations of the multiple trains comprises displaying multiple rail lines overlaid on the graphical representation of the geographical region.

5. The computer-implemented method of claim 1 wherein the act of displaying the locations of the multiple trains comprises displaying a shape of a locomotive for each of the multiple train symbols.

6. The computer-implemented method of claim 1 wherein the act of displaying the locations of the multiple trains comprises displaying a location of a particular train in an ocean when location information is unavailable for the particular train.

7. A computer-implemented method of tracking railroad cars during transit, the method comprising, in any order, at least the acts of:

inputting into a computer system location information for the railroad cars, wherein the location information is obtained from multiple sensors through at least one computer network;

using the computer system and using the location information for the railroad cars, displaying locations of multiple trains an a graphical representation of a geographical region, each of the multiple trains including at least one of the railroad cars, wherein each of the multiple trains is represented on the geographical region by one of multiple train symbols; and when an operator of the computer system selects a particular one of the multiple train symbols, displaying multiple railcar symbols for a particular one of the multiple trains that is represented by the particular one of the multiple train symbols, wherein one railcar symbol of the multiple railcar symbols is displayed for each of multiple of the railroad cars that make up the particular one of the multiple trains.

8. The computer-implemented method of claim 7 wherein each of the multiple railcar symbols is an image of a railcar.

9. The computer-implemented method of claim 8 wherein each of the multiple railcar symbols is an image of a tank car.

10. The computer-implemented method of claim 7 wherein the act of displaying the multiple railcar symbols for the particular one of the multiple trains that is represented by the particular one of the multiple train symbols comprises displaying a shape of a railcar for each of the multiple of the railroad cars that make up the particular one of the multiple trains.

11. The computer-implemented method of claim 7 wherein the act of displaying the multiple railcar symbols for the particular one of the multiple trains that is represented by the particular one of the multiple train symbols comprises displaying the multiple railcar symbols in a spiral pattern.

12. The computer-implemented method of claim 7 further comprising an act of displaying additional information for a particular railroad car of the railroad cars when one of the multiple of the railcar symbols representing the particular railroad car is selected by the operator of the computer system.

13. The computer-implemented method of claim 7 wherein, when two of the multiple trains are close together, at least one of the multiple train symbols that represent the two of the multiple trains is shown on the graphical representation of the geographical region at a shifted location with a line connecting the at least one of the multiple train symbols to an actual position of a train of the two of the multiple trains.

14. A computer-implemented method of tracking railroad cars during transit, the method comprising, in any order, at least the acts of:

inputting into a computer system location information for the railroad cars, wherein the location information is obtained from multiple sensors through at least one computer network;

using the computer system and using the location information for the railroad cars, displaying locations of multiple trains on a graphical representation of a geographical region, each of the multiple trains including at least one of the railroad cars, wherein each of the multiple trains is represented on the geographical region by one of multiple train symbols; and depicting on the geographical region a bad ordered car, the bad ordered car being one of the railroad cars.

15. The computer-implemented method of claim 14 wherein the bad ordered car is depicted at a last position of the location information received for the bad ordered car.

16. The computer-implemented method of claim 14 further comprising displaying history information for the bad ordered car when a specific train symbol of the multiple train symbols is selected by an operator of the computer system for a particular train that the bad ordered car was on before being dropped off the particular train, wherein the particular train is one of the multiple trains.

17. The computer-implemented method of claim 14 wherein the act of displaying the locations of the multiple trains comprises, when the bad ordered car has been separated from one of the multiple trains, displaying a train symbol for the one of the multiple trains and displaying a railcar symbol for the bad ordered car, wherein the train symbol and the railcar symbol each have a common reference character.

18. The computer-implemented method of claim 14 further comprising, when an operator of the computer system selects a particular one of the multiple train symbols, displaying one railcar symbol for each of multiple of the railroad cars that make up one of the multiple trains represented by the particular one of the multiple train symbols, wherein multiple of the railcar symbols are displayed for the particular one of the multiple trains, and wherein a first color of the one railcar symbol indicates an empty railroad car with a normal status, a second color of the one railcar symbol indicates a full railroad car with a normal status, and a third color of the one railcar symbol indicates a bad ordered railroad car.

19. The computer-implemented method of claim 18 wherein a fourth color of the one railcar symbol indicates a railroad car that has not moved in a particular period of time and wherein a fifth color of the one railcar symbol indicates a railroad car that has been released from being bad ordered.

20. The computer-implemented method of claim 14 further comprising:

filtering to show only bad ordered and held cars; and providing at least one report of the bad ordered and held cars.

* * * * *